United States Patent [19]

van Merksteijn

[11] Patent Number: 5,009,098

[45] Date of Patent: Apr. 23, 1991

[54] PRESS AND CURVE-FORMING MEANS THEREFOR

[75] Inventor: Jacobus L. van Merksteijn, Stad Delden, Netherlands

[73] Assignee: Machinefabriek Wila B.V., Lochem, Netherlands

[21] Appl. No.: 441,106

[22] Filed: Nov. 27, 1989

[51] Int. Cl.[5] ..... B21D 5/02; B21J 13/03

[52] U.S. Cl. ..... 72/389; 72/446; 72/462

[58] Field of Search ..... 72/389, 380, 446, 448, 72/462, 482; 100/258 R, 258 A

[56] References Cited

U.S. PATENT DOCUMENTS

| | | | |
|---|---|---|---|
| 965,529 | 7/1910 | Klocke | 72/456 |
| 4,347,727 | 9/1982 | Galiger | 72/389 |
| 4,354,374 | 10/1982 | Deguchi | 72/448 |
| 4,449,389 | 5/1984 | Cros | 72/389 |
| 4,586,361 | 5/1986 | Reinhorn et al. | 72/389 |
| 4,620,435 | 11/1986 | Gabella et al. | 72/448 |

FOREIGN PATENT DOCUMENTS

| | | | |
|---|---|---|---|
| 0067766 A3 | 12/1982 | European Pat. Off. . | |
| 2914744 A1 | 10/1980 | Fed. Rep. of Germany . | |
| 783147 | 7/1935 | France . | |
| 0144527 | 9/1984 | Japan | 72/389 |
| 0225818 | 12/1984 | Japan | 72/389 |
| 0129226 | 6/1986 | Japan | 72/389 |

*Primary Examiner*—David Jones

*Attorney, Agent, or Firm*—Christensen, O'Connor, Johnson & Kindness

[57] ABSTRACT

A press that includes a frame which bears a bending device that includes an upper tool and a lower tool which can be moved in a mutually reciprocal manner. The press also includes a curve-forming element for forming a curve on the bending device. The curve-forming element has curve-forming members slidable over each other in a lengthwise direction and a transverse direction and making contact with each other. The contact surface of the curve-forming members in the lengthwise direction and the transverse direction of the bending device possess the respective determined angles of slope $\alpha$ and $\beta$. The press has an element for adjusting the curve-forming members in the lengthwise direction and the transverse direction, wherein the curve-forming members adjoining each other at the sides preferably form a curve-forming strip which extends substantially over the whole length ofthe bending device. This curve-forming strip is preferably provided with a number of discrete contact surfaces.

18 Claims, 4 Drawing Sheets

PRESS AND CURVE-FORMING MEANS THEREFOR

TECHNICAL FIELD

The present invention relates to a press provided with curve-forming means according to the invention.

BACKGROUND OF THE INVENTION

Angular deviations in products formed by bending with a press are caused by sagging of the bending means whereby the bending tool can penetrate less deeply in places into the lower tool. The result is that the bending angle is not constant over the length of the product formed by bending.

Conventional methods by which the sagging is compensated comprise forming a curve on the upper and/or lower tool, whereby a certain sheer is given thereto. An example of such curve-forming means consists of a system of pairs of co-acting wedges which are arranged over the lengthwise direction of the bending means and which can cause a height adjustment in transverse direction thereof.

Another example of a known curve-forming means comprises a curve-forming strip with a great number of wedge surfaces arranged in lengthwise direction of the bending means, which strip is slidable in lengthwise direction and a height adjustment is possible with the separate wedges located on the wedge surfaces.

It has been found however that compensating for the predictable sagging with the known curve-forming means does not always lead to an optimal compensation. The bending means in any case comprise, in addition to the upper tool and the lower tool, a number of auxiliary elements such as an upper beam, a spacer, a table, a lower beam, and the like, which naturally display irregularities that are not predictable and are susceptible to change in the course of time. In other words, as a result of differences in tolerances of the mechanical elements used, it is in practice not possible to fully compensate with a curve-forming device according to the state of the art such that the product formed by bending possesses a substantially constant bending angle over its length.

It is noted that the combined use of the above mentioned curve-forming means acting in transverse direction and in lengthwise direction would lead to the desired result, but involves a great number of undesired practical drawbacks (long and repetitious adjustment process).

SUMMARY OF THE INVENTION

The invention has for its object to provide a press which substantially does not possess the above mentioned drawbacks and with which an optimal compensation of the sagging can be achieved. For this purpose the press according to the invention comprises a frame that bears bending means, which bending means comprise an upper tool and a lower tool, which can be moved in mutually reciprocal manner; curve-forming means for forming a curve on the bending means, which curve-forming means consist of curve-forming members slidable over each other in lengthwise direction and transverse direction of the bending means and making contact with each other, the contact surfaces of which in the lengthwise direction and the transverse direction of the bending means possess the respective determined angles of slope $\alpha$ and $\beta$; and means for adjusting the curve-forming members in lengthwise direction and transverse direction.

By first allowing the curve-forming means to act according to the invention on only one tool, the number of bending elements is decreased, the fitting height of the curve-forming means is smaller and the curve-forming means according to the invention can thereby be manufactured at lower cost.

If curve-forming members adjoining at the sides form a curve-forming strip which extends substantially over the whole length of the bending means, the theoretical sagging-compensation can be performed with the curve-forming strip and the tolerance compensation with the curve-forming members resting thereon.

DESCRIPTION OF THE PREFERRED EMBODIMENTS

According to a preferred embodiment the curve-forming strip is provided with a number of discrete contact surfaces of which the angle of slope is theoretically determinable and simply adjustable with known tools. A conflict between the curve-forming strip and the curve-forming members sliding thereover is avoided if more preferably the discrete contact surfaces are separated from each other by connecting surfaces. The total height of the curve-forming strip can remain considerably limited if the angle of slope of the connecting surfaces is chosen such that the contact surfaces begin substantially neutrally in relation to a common plane.

In accordance with another embodiment of the curve-forming strip according to the invention, the contact surfaces of the curve-forming strip form a continuous and fluently formed strip surface in lengthwise direction.

According to a very favorable embodiment of the press according to the invention the curve-forming members making mutual contact form two curve-forming strips. In this case the curve-forming means consist of two curve-forming strips slidable over one another in lengthwise and transverse direction.

To avoid metal fatigue and metal stresses as much as possible during curve-forming, it is recommended that the means adjusting in the lengthwise direction act on the lower curve-forming members, and the means acting in transverse direction act upon the upper curve-forming members resting thereon. An optimal transverse adjustment of the curve-forming strip is realized if the curve-forming strip adjustable in transverse direction is provided with transverse notchings.

In principle, the curve-forming means can be arranged in all elements of the bending means. In the case of fitting below the bending line it is favorable for the fitting height and the guiding if the curve-forming means are arranged in a lengthwise groove of a bottom surface of the work-table of the lower tool.

Since in general the sagging is at a maximum in the middle of the bending means, the angle of slope $\alpha$ will preferably decrease towards the outside in lengthwise direction from the middle of the bending means. A compensation by transverse adjustment is subsequently possible in every desired sense, depending on the current tolerances.

Finally, the invention relates to the above described curve-forming means according to the invention which can be incorporated into every type of press, which subsequently displays the effects and advantages of the invention.

Mentioned and other features will be further elucidated hereinafter by way of example on the basis of a number of embodiments, whereby reference is made to the annexed drawings. In the drawing.

Figure 1:
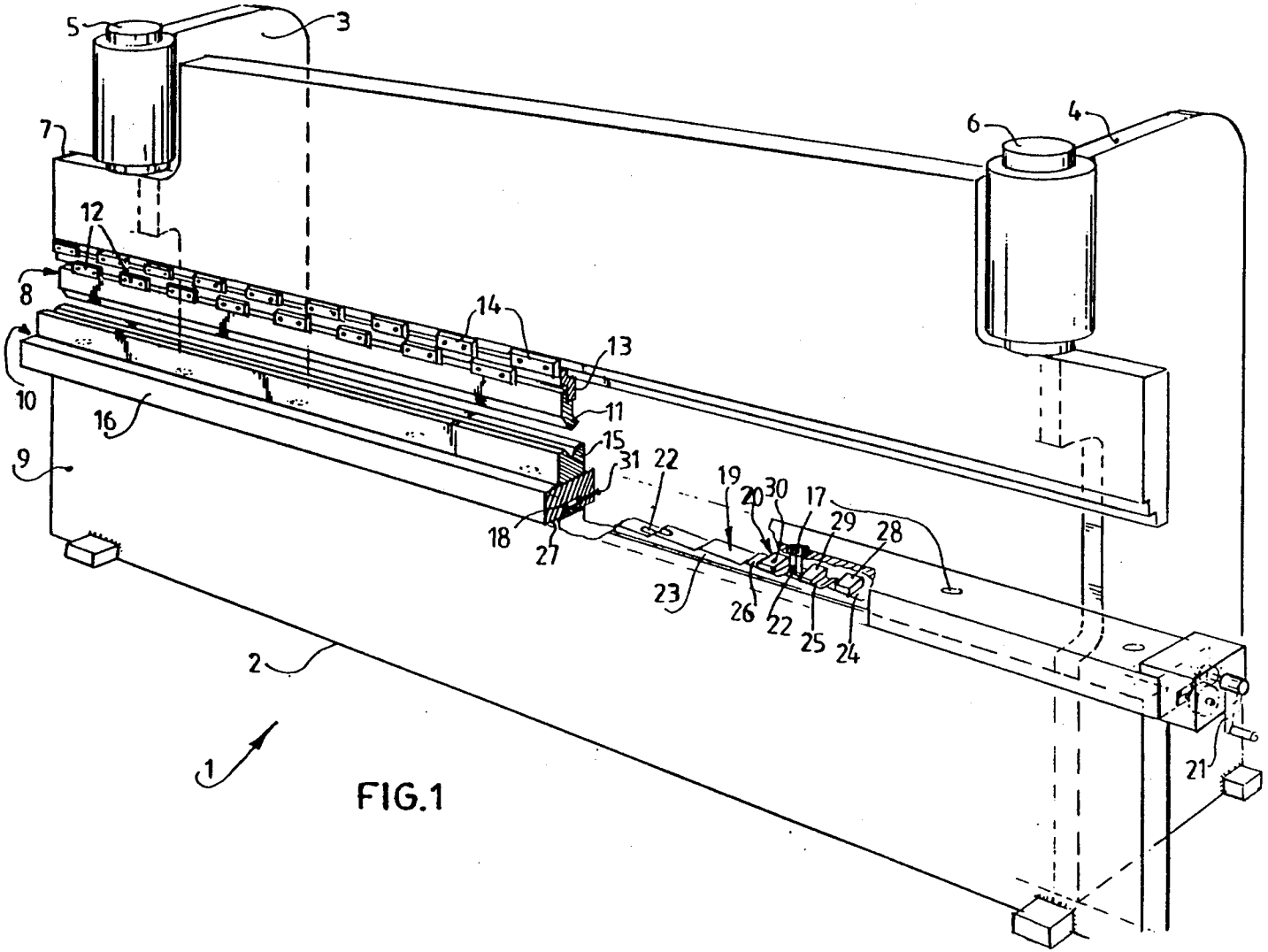
FIG. 1 shows a perspective, partly broken away view of a press with the curve-forming means according to the invention.

FIG. 1 shows a press 1 according to the invention. The press 1 comprises a frame 2 with two side frames 3 and 4 disposed at the sides and bearing hydraulic cylinders 5 and 6, with which bending means 8 fixed on an upper beam 7 are reciprocally movable in relation to curve-forming means 10 fixed on a stationary lower beam 9.

The bending means 8 comprise an exchangeable upper tool 11 that is fixed using clamping plates 12 to a spacer 13 which in turn is fixed to the topmost upper beam 7 with other clamping plates.

The bending means 10 comprise a lower tool 15 which is placed on a table 16 fastened onto the lower beam 9 using bolts 17. The table 16 is provided on its bottom surface 27 with a lengthwise groove 18 in which are arranged the curve-forming means 19 and 20 according to the invention. The curve-forming means 19 are displaceable in lengthwise direction of the bending means 10 using a crank-handle 21 or other known electrically or hydraulically driven means, with which a very accurate displacement of the curve-forming means 19 can be set.

The imaginary bending line of a product formed by bending lies between the upper and lower tool 11 and 15.

The curve-forming means 19 are provided with slotted holes 22 through which the bolts 17 protrude.

The curve-forming means 19 consist of a curve-forming strip 23 with a large number of discrete contact surfaces 24–26 of which the angle of slope $\alpha$ from a center between cylinders 5 and 6 decreases towards the outside, which will be described hereinafter in more detail with reference to FIG. 2.

On each contact surface rests a curve-forming member 28–30 embodied as a wedge which is slidable in transverse direction of the curve-forming strip 23 using draw and pushing bolts 31. The angle of slope B in transverse direction of the curve-forming strip is substantially the same for the contact surfaces 24–26.

Thus using the bending means 8 and 10 according to the invention, the lower tool 15 can be given a theoretically ideal sheer, which is subsequently compensated using the curve-forming means 20 to eliminate tolerance differences in the used bending means, their material composition and pattern of wear.

Figure 2:
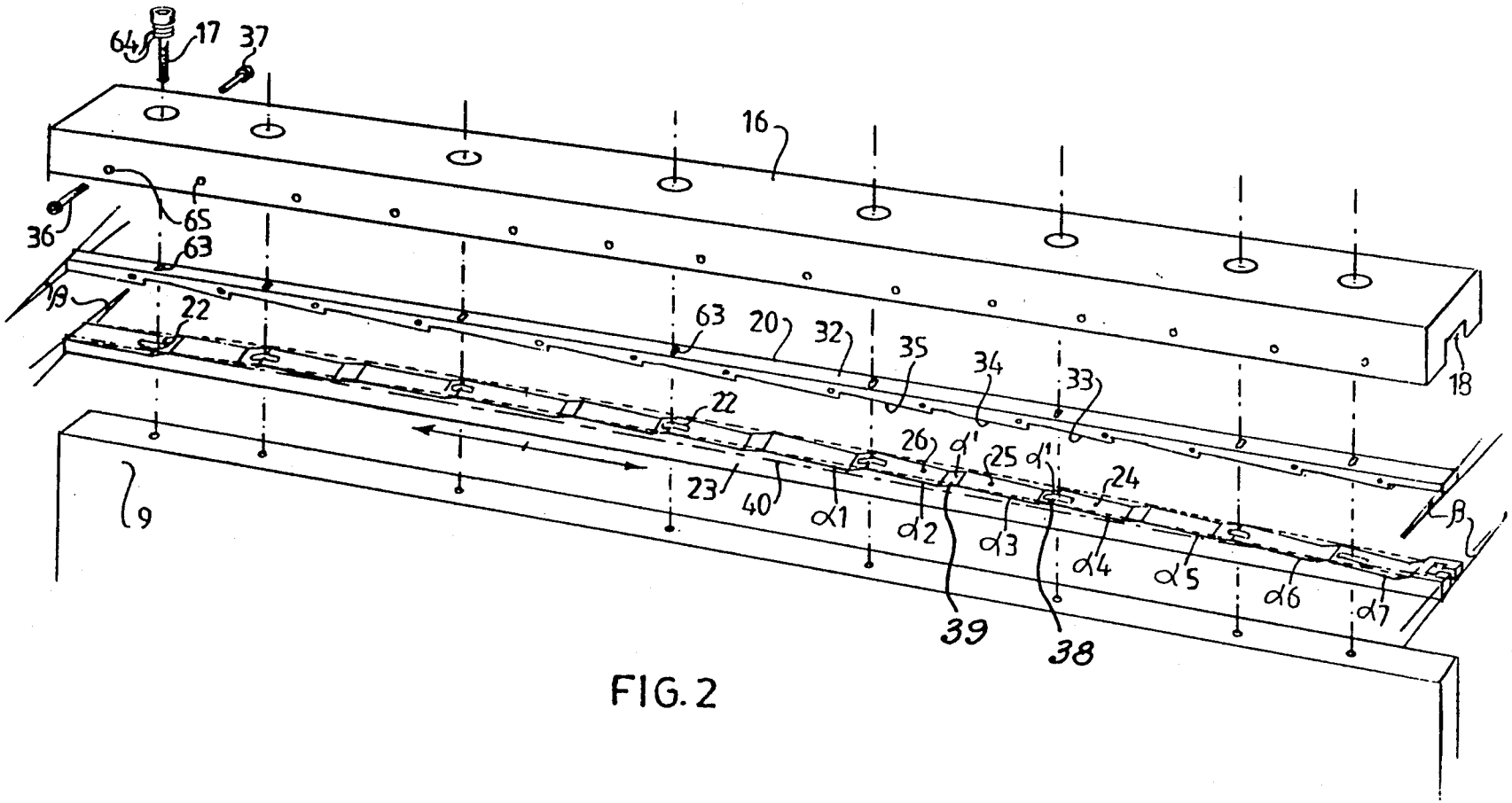
FIG. 2 shows on a larger scale the curve-forming means of the press in FIG. 1.

FIG. 2 shows a variant to the curve-forming means 20 according to the invention. In this case the curve-forming means 20 likewise consist of a curve-forming strip 32 of which for example the contact surfaces 33, 34 and 35 co-act with the respective contact surfaces 24, 25 and 26 of the curve-forming strip 23.

The angle of slope $\alpha$ in the lengthwise direction of the curve-forming strip 23 decreases from the middle in the direction to the sides and may even attain a negative value at the end of the curve-forming strip. For example $\alpha_1$ is equal to 0.02000 radials and $\alpha_7$ is equal to $-0.00344$ radials. In this manner a height displacement in the order of 1 mm is possible with a lengthwise displacement of the curve-forming strip 23.

The curve-forming strip 32 is likewise provided with slotted holes 63 running in transverse direction through which pass the bolts 17 provided with washers 64. The curve-forming strip 32 is adjustable in transverse direction relative to the curve-forming strip 23 using draw bolts 36 and pushing bolts 37 guided in holes 65.

Located between the contact surfaces 24–26 are connecting surfaces 38 and 39 which possess an angle of slope $\alpha'$ such that the contact surfaces 24, 25 and 26 lie substantially neutrally relative to a common plane 40 or a plane parallel thereto, in order that the fitting height of the curve-forming strip 23 remain limited.

Figure 3:
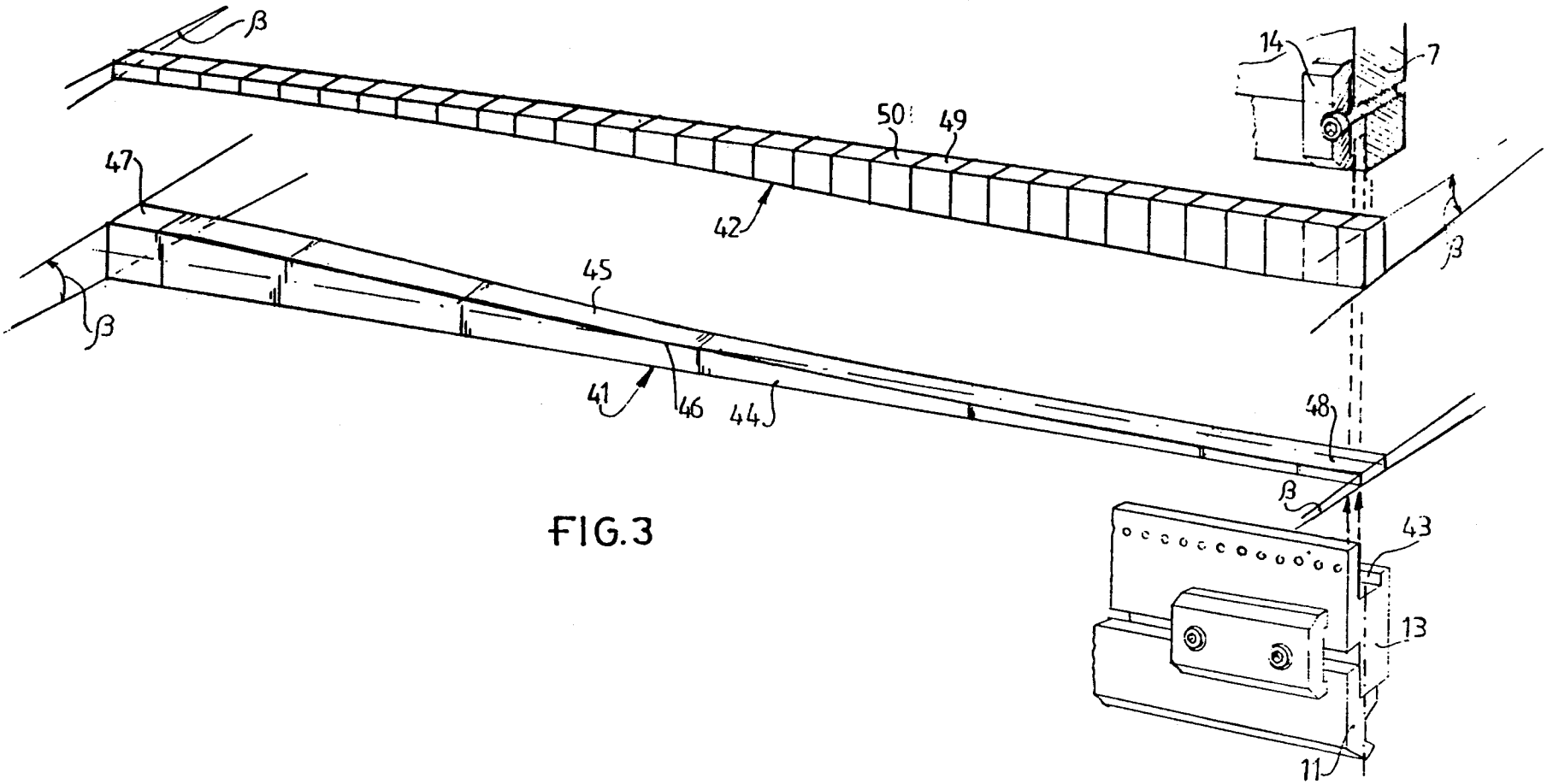
FIG. 3 is a perspective, partly broken away view of other curve-forming means according to the invention.

FIG. 3 shows another embodiment of the curve-forming means 41 and 42 according to the invention which in this case are guided in a groove 43 of the spacer 13.

The curve-forming means 41 comprise a curve-forming strip 44 with a strip surface 45 that is continuous and evenly curved in lengthwise direction and of which the angle of slope $\alpha$ is maximal at the location of the center 46 and can at the ends 47 and 48 possess a small and even a negative value.

In transverse direction the fluently curved strip surface has the above specified angle of slope $\beta$ in transverse direction which is substantially constant over the whole length of the curve-forming strip 44.

Analogously to the curve-forming means 20 from FIG. 1, the curve-forming means 42 in FIG. 3 consist of cold wedges 49, 50 placed against each other which rest on the strip surface 45 and have a height such that the total height of the curve-forming means 41 and 42 is constant.

With adjusting means (not shown) the curve-forming strip 44 is adjustable in lengthwise direction and the wedges 49, 50 in transverse direction thereto.

Figure 4:
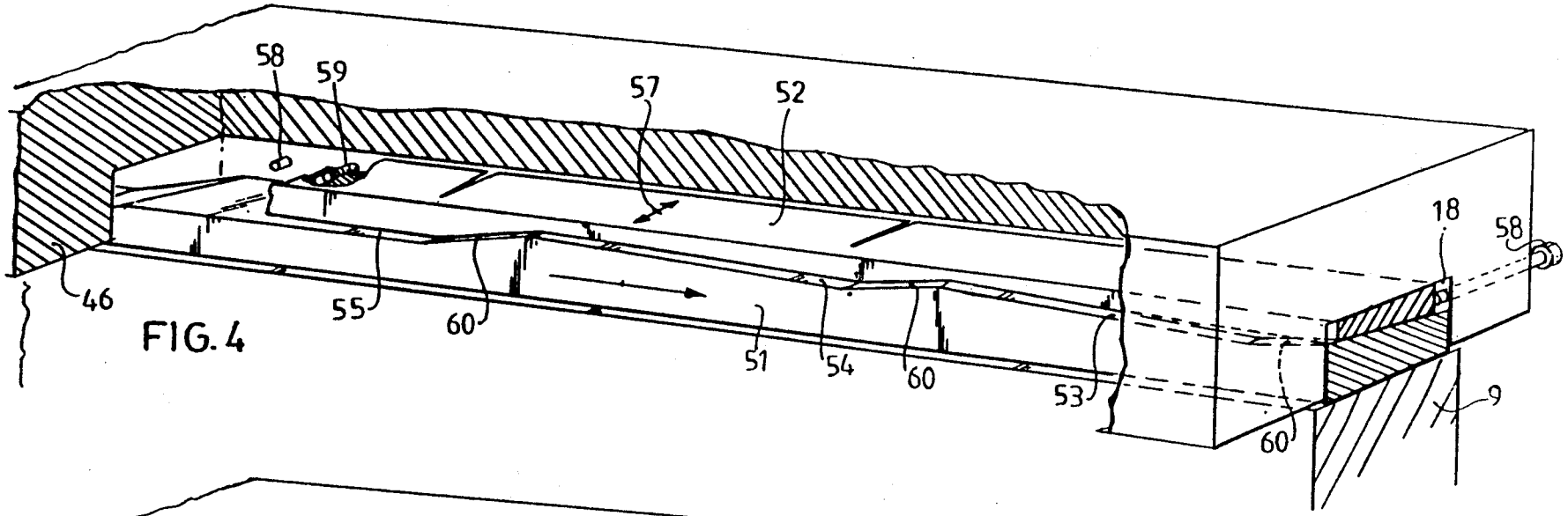
FIGS. 4 and 5 show a third embodiment of curve-forming means according to the invention respectively with transverse and lengthwise adjustment.
Figure 5:
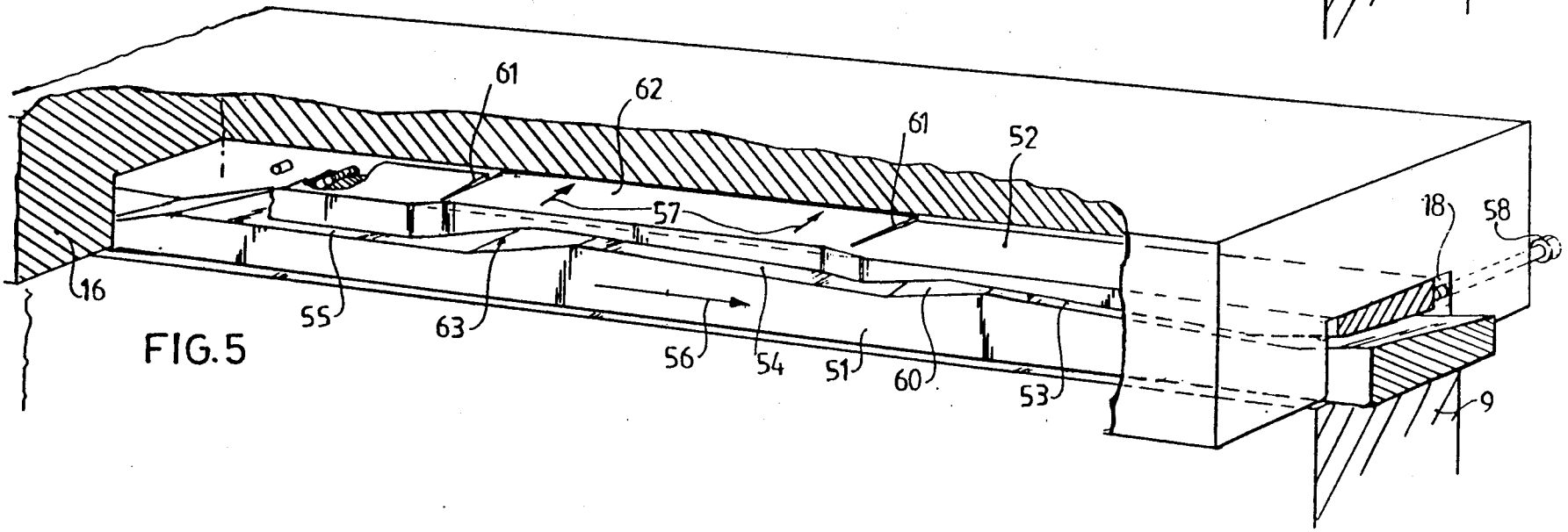

Finally, FIGS. 4 and 5 show a very favorable embodiment of the curve-forming means according to the invention. In this case two co-acting curve-forming strips are arranged as curve-forming means in the lengthwise groove 18 of table 16, which strips make contact with discrete contact surfaces 53–55 situated at a mutual interval. The lower curve-forming strip 51 is slidable in lengthwise direction as according to arrow 56 using for example the crank driving 21 as shown in FIG. 1, while the curve-forming strip 52 is transversely adjustable in the direction of the double arrow 57 using pushing bolts 58 and draw bolts 59.

FIG. 5 shows the situation in which the curve-forming strip 51 is moved in the direction of the arrow 56 and a portion 62 of the curve-forming strip 52 situated between the transverse notchings 61 is moved in transverse direction according to the arrows 57. With these curve-forming and compensating movements the curve-forming strips 51 and 52 maintain contact with the contact surfaces 53, 54 and 55 but a space 63 is created at the location of the connecting surfaces 60.

What is claimed is:

1. A press, comprising:

a frame which bears bending means, the bending means including an upper tool and a lower tool which can be moved in a mutually reciprocal matter;

curve forming means associated with the bending means for forming a curve on the bending means, the curve-forming means including curve-forming members slidable over each other in a lengthwise direction and in a transverse direction relative to the bending means and making contact with each other, the contact surfaces of the curve-forming members in the lengthwise direction and the transverse direction possess respective determined angles of slope $\alpha$ and $\beta$; and means for adjusting the curve-forming members in the lengthwise direction and the transverse direction.

2. A press as claimed in claim 1, wherein the curve-forming members adjoin each other at the sides and form a curve-forming strip which extends substantially over the whole length of the bending means.

3. A press as claimed in claim 2, wherein the curve-forming strip is provided with a number of discrete contact surfaces.

4. A press as claimed in claim 3, wherein the discrete contact surfaces are mutually separated by connecting surfaces.

5. A press as claimed in claim 4, wherein the connecting surfaces possess an angle of slope $\alpha'$, the angle of slope $\alpha'$ being chosen such that the contact surfaces are located substantially neutrally in relation to a common plane.

6. A press as claimed in claim 2, wherein the contact surfaces of the curve-forming strip form a continuous and fluently curved strip surface in the lengthwise direction.

7. A press as claimed in claim 2, wherein the curve-forming members making mutual contact form two curve-forming strips.

8. A press as claimed in claim 1, wherein the curve-forming means includes upper and lower curve-forming members, the lengthwise adjusting means acting upon the lower curve-forming members, and the transverse adjusting means acting upon the upper curve-forming members resting thereon, the upper curve-forming members being positioned between the lower curve-forming members and the lower tool.

9. A press as claimed in claim 2, wherein the curve-forming strip is adjustable in the transverse direction and is provided with transverse notchings.

10. A press as claimed in claim 1, wherein the curve-forming means are arranged in the bending means under the bending line.

11. A press as claimed in claim 10, wherein the curve-forming means are arranged in a lengthwise groove in a bottom surface of a work table for the lower tool.

12. A press as claimed in claim 1, wherein the curve-forming members are arranged in the bending means above the bending line.

13. A press as claimed in claim 1, wherein the angle of slope $\alpha$ decreases in the lengthwise direction from the middle of the bending means towards the outside.

14. A press as claimed in claim 6, wherein the curve-forming members making mutual contact form two curve-forming strips.

15. A press as claimed in claim 8, wherein the curve-forming strip is adjustable in the transverse direction and is provided with transverse notchings.

16. A press as claimed in claim 1, wherein the contact surface in the lengthwise direction relative to the bending means lies in a non-vertical plane and possesses respective determined angle of slope $\alpha$.

17. A press as claimed in claim 11, wherein the area of the surface of the curve-forming means that bears against the bottom surface of the work table for the lower tool is constant and independent of the adjustment of the curve-forming members in the lengthwise direction and the transverse direction.

18. A press as claimed in claim 8, wherein the upper curve-forming members are positioned directly above the lower curve-forming members.

* * * * *